US005518038A

United States Patent [19]

Steiner

[11] Patent Number: 5,518,038

[45] Date of Patent: May 21, 1996

[54] MODULAR SERIES-SHED WEAVING MACHINE

[75] Inventor: Alois Steiner, Rieden, Switzerland

[73] Assignee: Sulzer Rueti AG, Rueti, Switzerland

[21] Appl. No.: 288,376

[22] Filed: Aug. 10, 1994

[30] Foreign Application Priority Data

Sep. 24, 1993 [EP] European Pat. Off. ..... 93810680

[51] Int. Cl.[6] ..... D03D 49/02; D03D 41/00

[52] U.S. Cl. ..... 139/28; 139/1 R; 139/11; 139/304

[58] Field of Search ..... 139/28, 304, 1 R, 139/11

[56] References Cited

U.S. PATENT DOCUMENTS

| | | | |
|---|---|---|---|
| 2,893,440 | 7/1959 | Brusadelli | 139/28 |
| 4,105,052 | 8/1978 | Trost et al. | 139/DIG. 1 X |
| 4,170,249 | 10/1979 | Trost | 139/DIG. 1 |
| 4,291,729 | 9/1981 | Steiner | 139/28 |

FOREIGN PATENT DOCUMENTS

| | | | |
|---|---|---|---|
| 0012253 | 6/1980 | European Pat. Off. . | |
| 2280734 | 2/1976 | France . | |
| 2641235 | 3/1978 | Germany | 139/28 |
| 9115194 U | 5/1992 | Germany . | |

*Primary Examiner*—Andy Falik
*Attorney, Agent, or Firm*—Townsend and Townsend and Crew

[57] ABSTRACT

A series-shed weaving machine which has a machine frame. A warp beam and a weaving rotor are mounted on the frame and a reference plane extends between the axes of the warp beam and the rotor. A warp module is defined by a first subassembly, which includes an arrangement for warp run components of the machine, and a second subassembly, which includes an arrangement for cloth run components of the machine. It is mountable on the frame in first and second orientations in which one of the arrangements is on one side of the reference plane and the other one of the arrangements is on the other side of the reference plane and vice versa, respectively. Thus, the warp module can be installed on the weaving machine irrespective of how the warp beam and the cloth beam are arranged by laterally reversing the orientation of the warp module.

9 Claims, 3 Drawing Sheets

MODULAR SERIES-SHED WEAVING MACHINE

BACKGROUND OF THE INVENTION

The present invention relates to a series-shed weaving machine.

SUMMARY OF THE INVENTION

An object of the present invention is to provide a series-shed weaving machine which can be adapted to the given space conditions, and in which the ability of the weaver to operate the weaving machine is retained without being affected.

The advantages achievable with the invention are to be seen essentially in that the arrangements for the warp run and the cloth run, as well as the cloth beam, can be used with minor modifications, and that, with the different embodiments, the changing of a warp module can be executed in a practically unchanged manner.

BRIEF DESCRIPTION OF THE DRAWINGS

The invention will be explained in more detail in the following with reference to the accompanying drawings.

DESCRIPTION OF THE PREFERRED EMBODIMENTS

Figure 1:
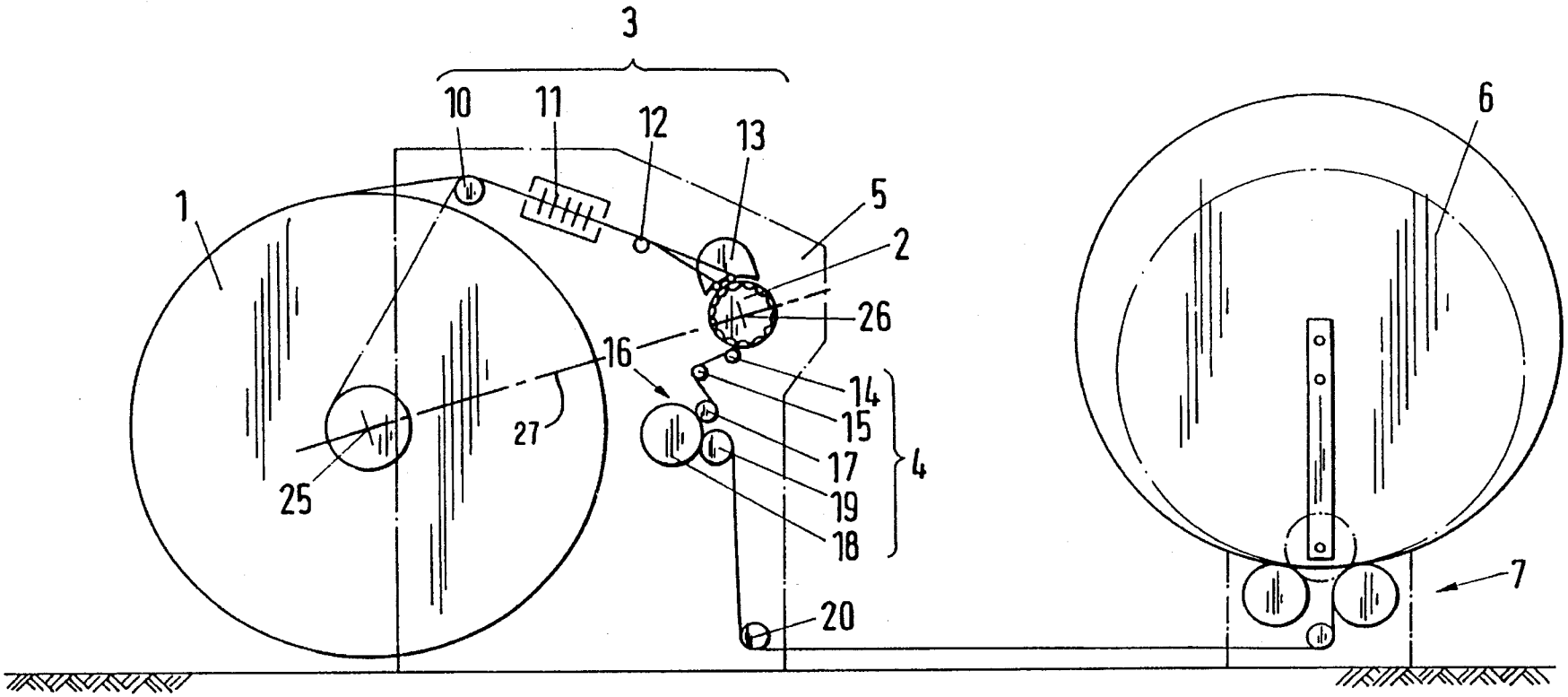
FIG. 1 is a side-view of one embodiment of a series-shed weaving made according to the invention.
Figure 2:
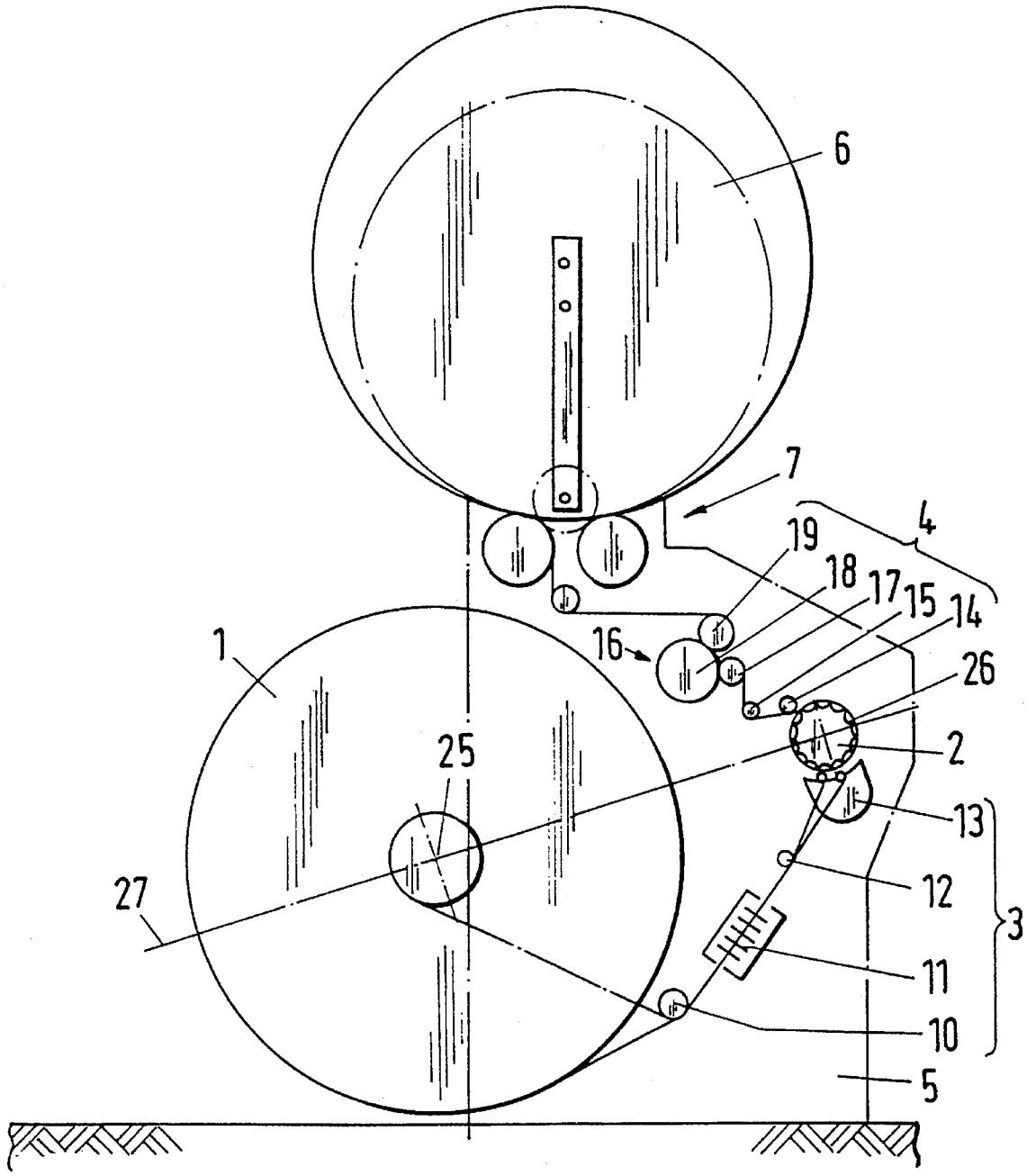
FIG. 2 a schematic representation of a side-view of another embodiment of a series-shed weaving machine made according to the invention.
Figure 3:
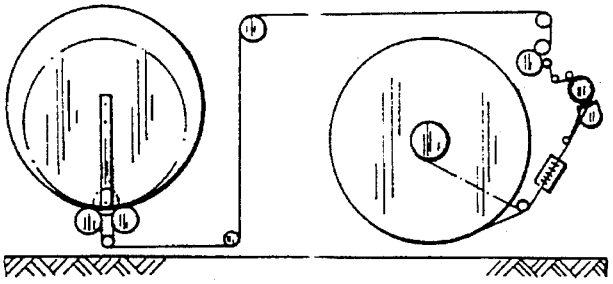
FIGS. 3–6 illustrate different embodiments of the series-shed weaving machine made according to the invention.
Figure 4:
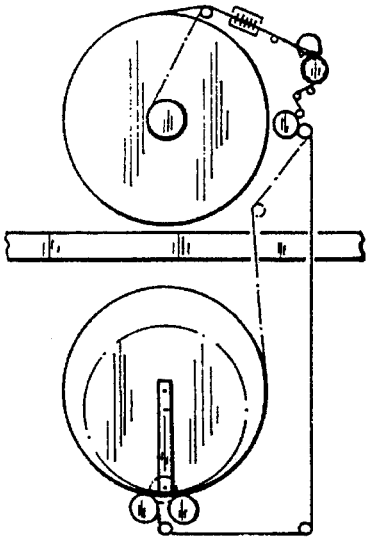
Figure 5:
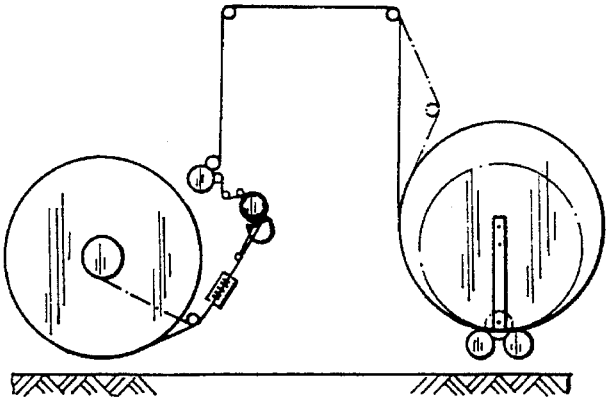
Figure 6:
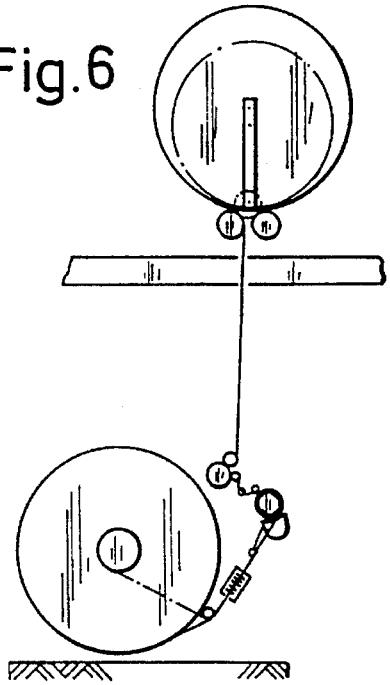

The series-shed weaving machines shown in FIGS. 1 and 2 each comprise a warp beam 1, a weaving rotor 2, an arrangement 3 for the warp run and an arrangement 4 for the cloth run which are provided in a frame 5, as well as a cloth beam 6 which is arranged in a large batch winder 7. Whereas, in the series-shed weaving machine according to FIG. 1, the cloth beam 6 is arranged at a distance from the weaving side of the machine, in the series-shed weaving machine according to FIG. 2 the cloth beam 6 is mounted with the large batch winder 7 on the frame 5. The arrangement 3 for the warp run, which represents a warp module, comprises a whip roll 10, a warp stop motion unit 11, a deflector bar 12 and a warp thread guiding unit 13. The arrangement 4 for the cloth run comprises a temple 14, a spreader bar 15 and a cloth take-off device 16 having a deflector tube 17, a draw-in roll 18 and a pressure roll 19. With the series-shed weaving machine according to FIG. 1, a deflector roll 20 is further provided over which the cloth is led to the large batch winder 7.

The rotational axes 25, 26 of the warp beam 1 and of the weaving rotor 2 are in fixed positions on the frame 5 and define a plane 27 extending from one axis to the other. The arrangements 3 and 4 together form a warp module which can be positioned on frame 5 relative to plane 27 so that one of the arrangements 3, 4 is located above and the other arrangement is located below the reference plane, or vice versa. Thus, the warp module can be installed on a weaving machine irrespective of how warp beam 1 and cloth beam 6 are arranged by laterally reversing the warp module as can be seen, for example, by comparing the relative positions of the warp module shown in FIGS. 1 and 2.

In addition to the above described embodiments of the series-shed weaving machine, other embodiments are possible such as, for example, those schematically represented in FIGS. 3 to 6.

What is claim is:

1. Series-shed weaving machine comprising a machine frame; a warp beam having a first rotational axis; a weaving rotor having a second rotational axis; said warp beam and weaving rotor being mounted on said frame; a warp module removably attached to the frame and including a first arrangement for a warp run and a second arrangement for a cloth run for supplying the rotor with warp thread and directing a woven article from the rotor to a cloth beam of the machine, respectively; and means for mounting said warp module to said frame so that said first and second arrangements can alternatively be positioned on one or another side of a plane aligned with said first and second rotational axes.

2. Series-shed weaving machine comprising a machine frame, a warp beam and a weaving rotor mounted on the frame, the beam and the rotor being spaced apart and having parallel axes defining a plane extending from one of the axes to the other one, a first subassembly including an arrangement for a warp run of the machine, a second subassembly including an arrangement for a cloth run of the machine, the arrangement for the warp run and the arrangement for the cloth run forming a warp module, and means for mounting the warp module on the frame in first and second orientations in which one of the arrangements is on one side of the plane and the other one of the arrangements is on the other side of the plane and vice versa, respectively.

3. Weaving machine according to claim 2 including a cloth beam and a second frame mounting the cloth beam.

4. Weaving machine according to claim 3 wherein the sides of the plane form an upper side and a lower side, and wherein the arrangement for the warp run is located on the upper side of the plane and the cloth beam is arranged below the warp beam.

5. Weaving machine according to claim 3 wherein the sides of the plane form an upper side and a lower side, wherein the arrangement for the warp run is located on the upper side of the plane, wherein the machine has a weaving side, and wherein the cloth beam is arranged on the weaving side and at a distance from the weaving rotor.

6. Weaving machine according to claim 3 wherein the sides of the plane form an upper side and a lower side, and wherein the arrangement for the warp run is located on the lower side of the plane and wherein the cloth beam is arranged above the warp beam.

7. Weaving machine according to claim 3 wherein the sides of the plane form an upper side and a lower side, and wherein the arrangement for the warp run is located on the lower side of the plane, wherein the machine has a weaving side, and wherein the cloth beam is arranged on the weaving side and at a distance from the weaving rotor.

8. Weaving machine according to claim 2 wherein the arrangement for the warp run includes a whip roll, a warp stop motion unit, a deflector member and a warp thread guiding unit.

9. Weaving machine according to claim 2 wherein the arrangement for the cloth run includes a cloth drawing-off device, a spreader bar and a temple.

* * * * *